US007694925B2

(12) United States Patent
Kokenge et al.

(10) Patent No.: US 7,694,925 B2
(45) Date of Patent: Apr. 13, 2010

(54) STORAGE SYSTEMS HAVING STORAGE ACCESSORY WITH LOCKING TAB

(75) Inventors: John Kokenge, Cincinnati, OH (US); Jonathan Doench, Cincinnati, OH (US); Bryan Goodpaster, Cincinnati, OH (US)

(73) Assignee: Schulte Corporation, Cincinnati, OH (US)

( * ) Notice: Subject to any disclaimer, the term of this patent is extended or adjusted under 35 U.S.C. 154(b) by 497 days.

(21) Appl. No.: 11/652,441

(22) Filed: Jan. 11, 2007

(65) Prior Publication Data

US 2008/0169255 A1 Jul. 17, 2008

(51) Int. Cl.
*F21V 21/00* (2006.01)

(52) U.S. Cl. ..... 248/220.42; 248/304

(58) Field of Classification Search ..... 248/220.43, 248/221.11, 220.41, 220.31, 223.41, 220.21, 248/302, 303, 551
See application file for complete search history.

(56) References Cited

U.S. PATENT DOCUMENTS 532,109 A * 1/1895 Danner et al. ..... 248/303
2,797,059 A * 6/1957 Uhrin ..... 248/303
3,385,547 A * 5/1968 West ..... 248/308
4,303,217 A * 12/1981 Garfinkle ..... 248/220.42
D320,152 S * 9/1991 Schreib ..... D8/367
6,129,221 A * 10/2000 Shaha ..... 211/87.01
6,991,204 B2 * 1/2006 Ay ..... 248/308
7,207,542 B2 * 4/2007 Conway et al. ..... 248/458
D550,540 S * 9/2007 Nawrocki ..... D8/354
7,427,053 B2 * 9/2008 Nawrocki ..... 248/220.21
7,451,956 B2 * 11/2008 Bohlen ..... 248/265
2003/0071181 A1 * 4/2003 Valiulis et al. ..... 248/220.43

* cited by examiner

*Primary Examiner*—J. Allen Shriver, II
*Assistant Examiner*—Erin Smith
(74) *Attorney, Agent, or Firm*—Dinsmore & Shohl LLP

(57) ABSTRACT

A storage accessory is configured for selective attachment to a wall support member. The storage accessory includes a hanging tab and a locking tab. The locking tab is movable between an unlocked position and a locked position. In the unlocked position, the locking tab is configured not to penetrate a groove in a wall support member and thus to allow removal of the hanging tab from a wall support member. In the locked position, the locking tab is configured to penetrate a groove in a wall support member and thus to prevent removal of the hanging tab from a wall support member.

21 Claims, 14 Drawing Sheets

STORAGE SYSTEMS HAVING STORAGE ACCESSORY WITH LOCKING TAB

TECHNICAL FIELD

The present invention relates to storage systems having a wall support member and a storage accessory with a locking tab.

BACKGROUND OF THE INVENTION

Modular storage systems are commonly installed in homes and businesses and include at least one wall support member and at least one storage accessory. The wall support member is sometimes called a rail or vertical standard, and has one or more vertical rows of grooves (or apertures or slots). The wall support member can be secured to a wall using various types of brackets and/or fasteners. The storage accessory can be removably attached to the wall support member and can comprise, for example, a hook, basket, shelf bracket, or bin. The location of the storage accessory relative to the wall support member can be adjusted simply by disengaging the storage accessory from grooves in the wall support member, and then reengaging the storage accessory with different grooves in the wall support member. For example, when a storage accessory is used with a vertically oriented wall support member, the height of the storage accessory may be adjusted simply by moving the storage accessory to engage different grooves in the wall support member.

Some conventional storage accessories are simple to remove from conventional wall support members, thereby facilitating ease of assembly and reconfiguration of such storage systems. However, these conventional storage accessories often too easily become dislodged from the conventional wall support member. Other conventional storage accessories are less likely to become dislodged from a conventional wall support member, but are difficult and time-intensive to assemble and reconfigure, and/or require use of tools.

SUMMARY OF THE INVENTION

In accordance with one embodiment of the present invention, a storage system comprises a wall support member and a storage accessory, the wall support member comprising a groove. The storage accessory comprises a utility member, a hanging tab, and a locking tab. The utility member is configured for supporting an item. The hanging tab is configured for selective insertion into the groove to facilitate hanging of the storage accessory upon the wall support member. The locking tab is movable between a locked position and an unlocked position. The locking tab is configured, when in the locked position, to selectively interface the wall support member to prevent removal of the hanging tab from the groove in the wall support member and, when in the unlocked position, to facilitate selective removal of the hanging tab from the groove in the wall support member.

In accordance with another embodiment of the present invention, a storage accessory is configured for selective attachment to a wall support member. The storage accessory comprises a retention member, a utility member, and a locking member. The retention member comprises a hanging tab configured for selective insertion into a groove in a wall support member. The hanging tab includes a ledge configured for selectively contacting a wall support member to facilitate hanging of the storage accessory upon a wall support member. The utility member is configured for supporting an item. The locking member comprises a locking tab. The locking tab is movable with respect to the retention member between an unlocked position and a locked position. In the unlocked position, the locking tab is configured not to penetrate a groove in a wall support member and thus to allow removal of the hanging tab from a wall support member. In the locked position, the locking tab is configured to penetrate a groove in a wall support member and thus to prevent removal of the hanging tab from a wall support member.

In accordance with one embodiment of the present invention, a storage accessory is configured for selective attachment to a wall support member. The storage accessory comprises a retention member, a utility member, and a locking member. The retention member comprises a first hanging tab, a second hanging tab, a third hanging tab, and a fourth hanging tab. Each of the four hanging tabs are configured for selective insertion into respective grooves in a wall support member to facilitate hanging of the storage accessory upon a wall support member. Each of the first hanging tab and the second hanging tab are horizontally aligned and spaced from one another. Each of the third hanging tab and the fourth hanging tab are horizontally aligned and spaced from one another. Each of the first hanging tab and the third hanging tab are vertically aligned and spaced from one another. Each of the second hanging tab and the fourth hanging tab are vertically aligned and spaced from one another. The utility member is attached with respect to the retention member and is configured for supporting an item. The locking member is hingedly attached with respect to the retention member and comprises a first locking tab and a second locking tab. The locking member is movable with respect to the retention member between an unlocked position and a locked position. In the unlocked position, the first locking tab and the second locking tab are both configured not to penetrate a wall support member and thus to allow removal of the four hanging tabs from a wall support member. In the locked position, the first locking tab is configured to penetrate a groove in a wall support member in which the first hanging tab is inserted, and the second locking tab is configured to penetrate a groove in a wall support member in which the second hanging tab is inserted.

BRIEF DESCRIPTION OF THE DRAWINGS

While the specification concludes with claims particularly pointing out and distinctly claiming the present invention, it is believed that the same will be better understood from the following description, taken in conjunction with the accompanying drawings, in which:

DETAILED DESCRIPTION

Figure 1:
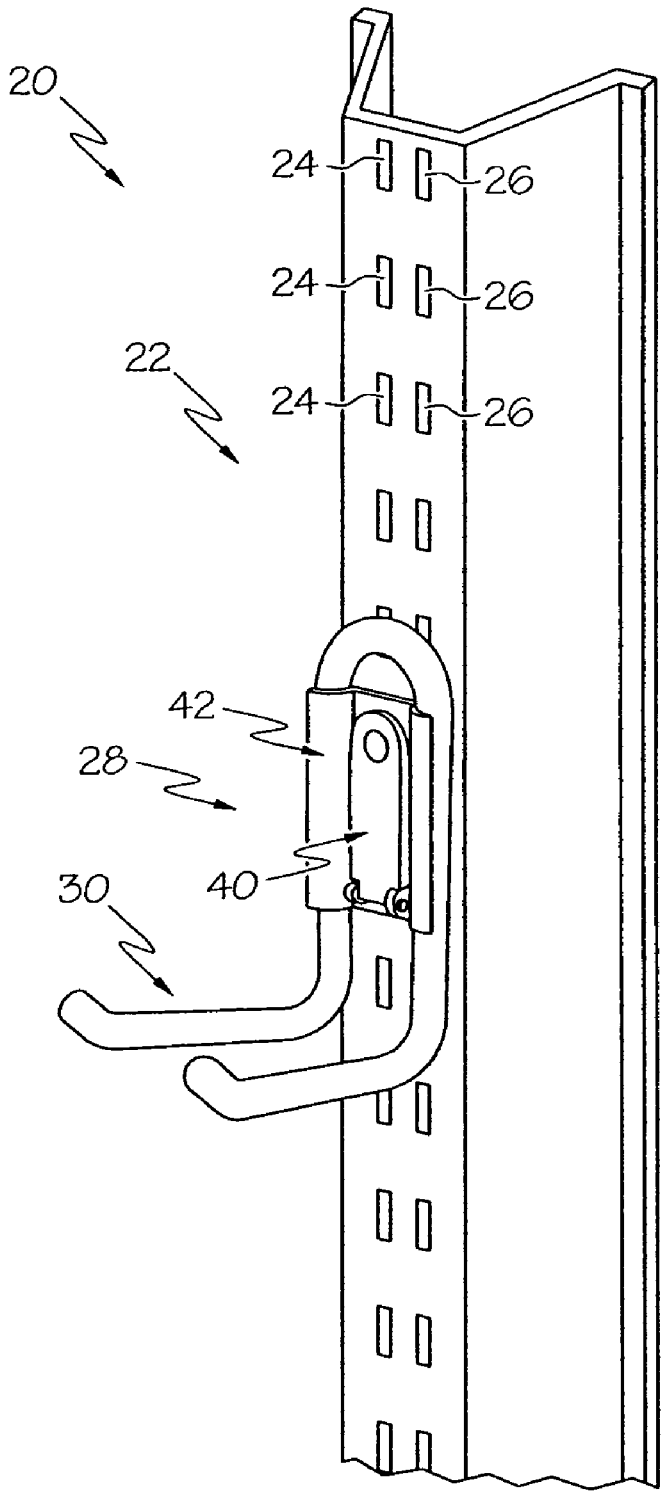
FIG. 1 is a front perspective view depicting a storage system in accordance with one embodiment of the present invention.

Reference will now be made in detail to embodiments of the present invention illustrated in the accompanying drawings, wherein like numerals indicate corresponding elements throughout the views. A storage system in accordance with one embodiment of the present invention can comprise a modular shelving system. For example, as shown in FIG. 1, a storage system 20 is shown to comprise a wall support member 22 and a storage accessory 28. As will be described in further detail herein, the wall support member 22 can be attached to a wall or other vertical structure through use of fasteners, brackets and/or otherwise, and is often termed a rail or vertical standard. One or more storage accessories (e.g., 28) can be selectively attached to the wall support member 28 to facilitate hanging of items to be stored.

The wall support member 22 can include grooves to facilitate attachment of one or more storage accessories (e.g., 28) to the wall support member 22. The wall support member 22 can be formed in any of a variety of alternative configurations and from any of a variety of alternative materials. However, in one embodiment of the present invention, the wall support member 22 is formed from metal such as steel. The metal can be stamped, rolled, extruded, or otherwise formed into any of a variety of suitable shapes. For example, as shown in FIG. 1, the wall support member 22 can be formed to have what generally can be described as a "U" shape.

The grooves can be provided upon a wall support member in any of a variety of configurations in accordance with alternative embodiments of the present invention. In accordance with one embodiment of the present invention, as shown in FIG. 1, the wall support member includes two rows of vertically spaced grooves. In particular, the first row includes grooves 24 and the second row includes grooves 26. It will be appreciated that a wall support member in accordance with an alternative embodiment of the present invention might include only one row of vertically spaced grooves, or might alternatively include more than two rows of vertically spaced grooves. It will also be appreciated that while each individual groove 24, 26 is depicted as having a generally rectangular shape, a wall support member in accordance with other embodiments of the present invention can include grooves having any of a variety of other shapes. In one embodiment of the present invention, each of the groves can extend entirely though the wall support member (e.g., as shown in FIGS. 7A-7E).

A storage accessory in accordance with one embodiment of the present invention can be configured for selective attachment to the wall support member 22. For example, with reference to FIGS. 1-4, the storage accessory 28 comprises a retention member 42 and a utility member which, in the depicted embodiment, comprises a hook 30. The retention member 42 is configured for selective attachment to the wall support member 22. The utility member is attached to the retention member 42 and is configured to support one or more items with respect to the wall support member 22 once the retention member 42 is attached to the wall support member 22. For example, as shown in FIG. 1, wherein the retention member 42 is attached to the wall support member 22, the hook 30 is shown to include support portions 31 which can be used to support an extension cord, a hose, a broom, jumper cables, clothing, and/or any of a variety of other items.

In alternative embodiments of the present invention, some of which will be described in further detail below, a utility member might not comprise a hook, but might rather comprise a basket, shelf bracket, or bin. In one embodiment of the present invention, respective wall support members can be attached to a common wall at locations spaced from one another, and respective storage accessories can be attached to each of the wall support members, wherein each of the storage accessories comprises a utility member in the form of a shelf bracket. A shelf can then be laid across or otherwise attached to the shelf brackets to facilitate storage of items upon the shelf. Accordingly, through use of a storage system including multiple wall support members and multiple storage accessories having differing types of utility members, it will be appreciated that the storage system can be used to facilitate organized storage of virtually any collection of objects to be stored (e.g., in a garage, closet, retail establishment, or workshop). It will therefore be appreciated that a utility member can be formed from any of a variety of materials, and to have any of a variety of configurations. In one particular embodiment of the present invention, the utility member is formed from metal such as steel. In another embodiment of the present invention, one or more portions of the storage accessory 28 can be coated such as with rubber or paint. For example, with respect to the storage accessory 28, in one embodiment, the support portions 31 can be formed from steel but can be coated with rubber to provide enhanced friction for gripping an item.

Accordingly, it will be appreciated that a storage accessory can have any of a variety of alternative configurations in accordance with embodiments of the present invention. By way of example, the storage accessory of FIGS. 1-4 includes a retention member 42 having a hanging member 44 and an attachment member 46. The hanging member 44 includes multiple hanging tabs 32, 33, 34, and 35 which can each be configured for selective simultaneous insertion into at least one groove in the wall support member 22. Each of the hanging tabs 32 and 33 are shown to be horizontally aligned and spaced from one another, and each of the hanging tabs 34 and 35 are shown to be horizontally aligned and spaced from one another, while each of the hanging tabs 32 and 34 are shown to be vertically aligned and spaced from one another, and each of the hanging tabs 33 and 35 are shown to be vertically aligned and spaced from one another. Each of the hanging tabs 32, 33, 34 and 35 includes a respective ledge 52, 53, 54, and 55, one or more of which ledges can be configured for selectively contacting the wall support member 22 adjacent to the respective groove(s) to facilitate hanging of the storage accessory 28 upon the wall support member 22. In other embodiments of the present invention, a retention member of a storage accessory might comprise fewer than four hanging tabs, or might alternatively comprise more than four hanging tabs, and the hanging tab(s) can be provided in any of a variety of suitable configurations.

With respect to the storage accessory 28 depicted in FIGS. 1-4, the attachment member 46 can serve to facilitate attachment of the utility member to the hanging member 44 and/or a locking member 38. The retention member 42 can be formed from any of variety of materials. For example, in one embodiment of the present invention, each of the hanging member 44 and the attachment member 46 are formed from metal such as steel. The metal can be stamped, rolled, extruded, or otherwise formed into any of a variety of suitable shapes. While the hanging member 44 and the attachment member 46 can both be formed from the same material (e.g., steel), it will be appreciated that, in other embodiments of the present invention, the hanging member 44 and the attachment member 46 can be formed from different materials. In one embodiment of the present invention, the hanging member 44, the attachment member 46, and the utility member can all be welded together (e.g., through a spot welding process). In another embodiment of the present invention, the hanging member 44, the attachment member 46, and the utility member can be attached through use of adhesive, fasteners, an interlocking mechanical configuration, or otherwise. In still another embodiment of the present invention, each of the hanging member and the attachment member can be integrally provided (e.g., stamped from the same sheet of steel in a single process). In still another embodiment of the present invention, each of the hanging member, the attachment member, and the utility member can be integrally provided (e.g., stamped from the same sheet of steel in a single process). It will also be appreciated that the retention member can have any of variety of suitable shapes and configurations alternative to that depicted in FIGS. 1-4.

Figure 6:
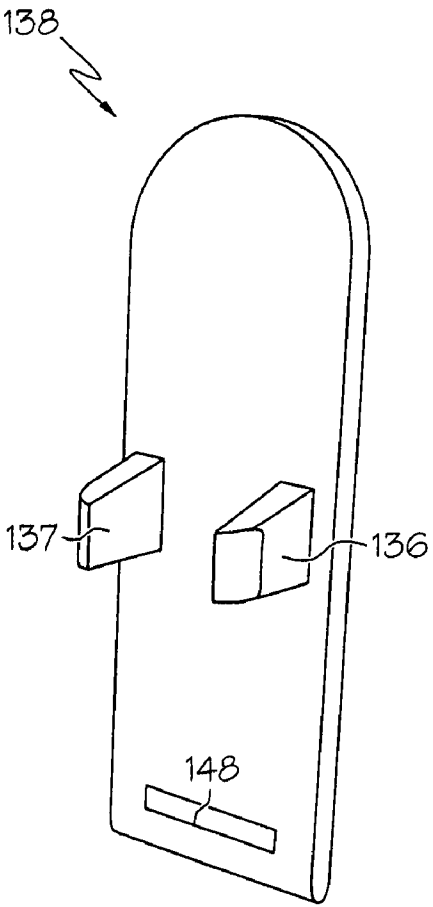
FIG. 6 is rear perspective view depicting the locking tab of FIG. 5.
Figure 5:
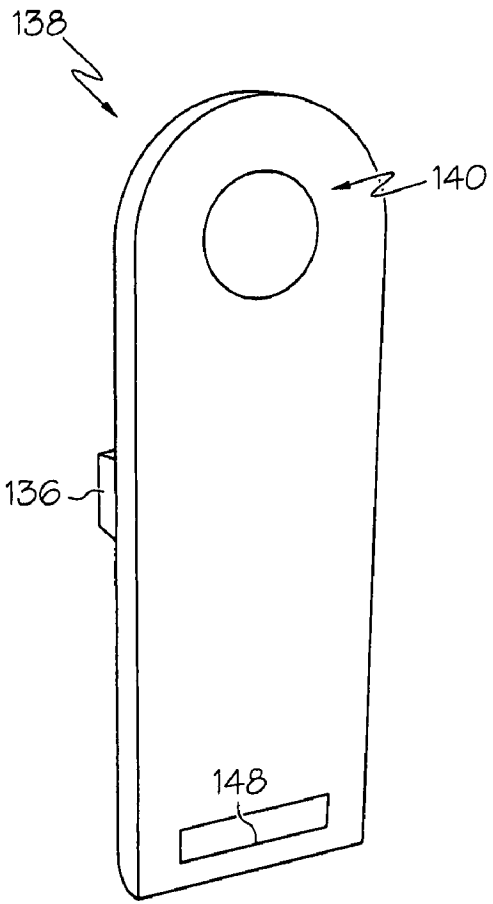
FIG. 5 is a front perspective view depicting a locking tab for a storage accessory in accordance with an alternative embodiment of the present invention.

A storage accessory in accordance with one embodiment of the present invention can also include one or more locking tabs which is/are configured to selectively prevent removal of a storage accessory which is attached to a wall support member. The locking tabs can be provided upon a storage accessory in any of a variety of suitable manners in accordance with the present invention. In one embodiment of the present invention, the locking tab(s) can be hingedly attached with respect to hanging tabs present on the storage accessory. For example, the locking tab(s) can be provided as part of a locking member, and the locking member can be attached with respect to the hanging tab(s) and utility member of a storage accessory in any of a variety of alternative manners. For example, as shown in FIGS. 1-4, the storage accessory 28 comprises the locking member 38. The locking member 38 is shown as being hingedly attached to the retention member 42 by way of tabs 48 of the locking member 38 being retained within hooks 50 of the attachment member 46. It will be appreciated that any of a variety of alternative hinged, pivotal, or other attachments might be provided between a locking member and other components of a storage accessory. For example, as shown in FIGS. 5-6, a locking member 138 in accordance with an alternative embodiment of the present invention can have locking tabs 136 and 137, a grip portion 140, and a single aperture or indentation 148 configured to facilitate a pivotal connection between the locking member 138 and a retention member of a storage accessory. In another alternative embodiment of the present invention, the locking member might be attached to some other portion of the retention member and/or to the utility member.

The locking member can be formed from any of a variety of suitable materials such as, for example, metal, plastic, rubber, fiberglass, composites, or a combination thereof. In one particular embodiment of the present invention, the locking member is formed from plastic. The locking member can also have any of a variety of suitable shapes and configurations. For example, as shown in the example of FIGS. 1-4, in addition to the above-mentioned tabs 48, the locking member 38 comprises a grip portion 40 and locking tabs 36 and 37. The grip portion 40 can be configured to facilitate use of an operator's finger to effectuate pivotal movement of the locking member 38 about a hinge axis provided by the interface between the tabs 48 and the hooks 50, and thus resultant movement of the locking tabs 36 and 37.

Through use of the grip portion 40, the locking tabs 36 and 37 are thus moveable with respect to the retention member 42 between an unlocked position and a locked position. In the unlocked position, as shown in FIG. 7D, for example, the locking tabs 36 and 37 are configured not to penetrate any grooves in the wall support member 22, and thus to allow removal of the hanging tabs 32, 33, 34 and 35 from the wall support member 22. However, when in the locked position, the locking tabs 36 and 37 can pass through respective apertures in the 60 and 61 in the attachment member 46, through respective passages 62 and 63 defined by the hanging member 44, and then to penetrate respective grooves 24 and 26 in the wall support member 22. When penetrating the grooves 24 and 26 in the wall support member 22 (as shown in FIG. 7E), the locking tabs 36 and 37 prevent removal of the hanging tabs 32, 33, 34 and 35 of the retention member 42 from the wall support member 22, and therefore prevent the storage accessory 28 from being removed from the wall support member 22. Accordingly, the locking tabs 36 and 37 are each shown to be configured, when in the locked position, such that at least a portion of each locking tab 36 and 37 selectively penetrates the respective grooves 24 and 26 in the wall support member 22 and, when in the unlocked position, such that no portion of the locking tabs 36 and 37 selectively penetrate the respective grooves 24 and 26 in the wall support member 22.

Figure 7A:
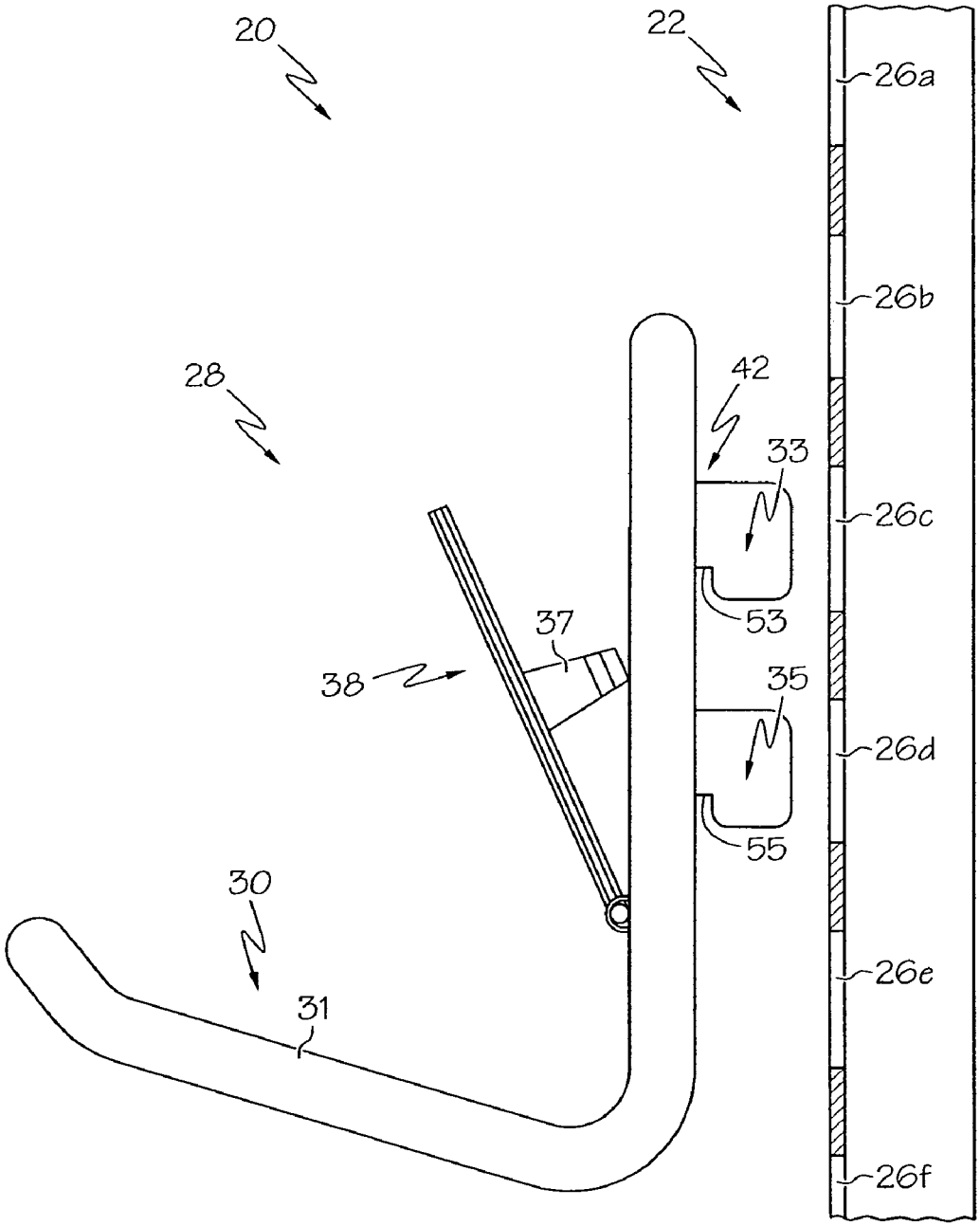
FIG. 7A is a side view depicting a portion of the storage system of FIG. 1, wherein the wall support member is shown in cross-section, and wherein the hanging tabs of the storage accessory are not inserted into the grooves of the wall support member.
Figure 7B:
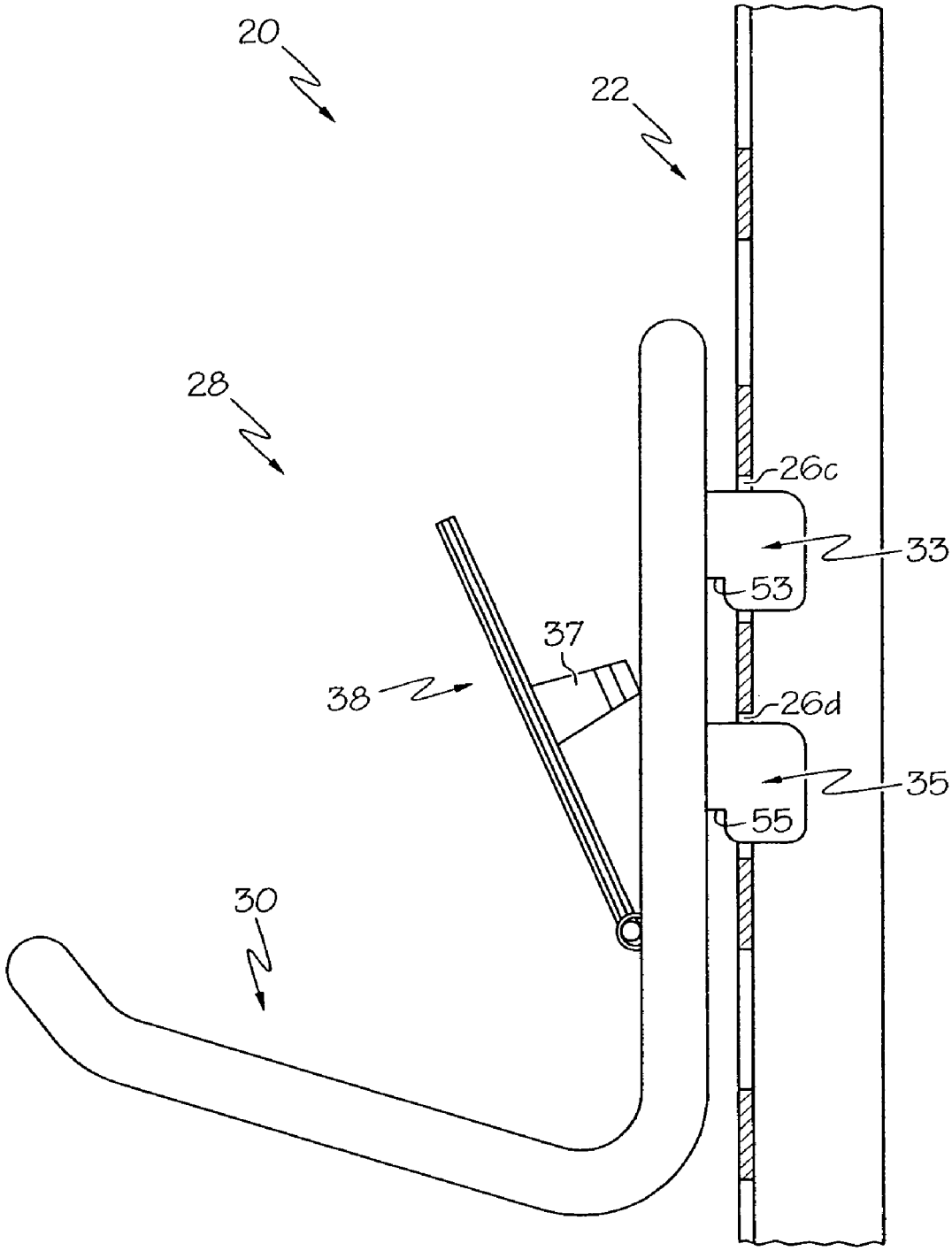
FIG. 7B is a side view depicting a portion of the storage system of FIG. 1, wherein the wall support member is shown in cross-section, and wherein the hanging tabs of the storage accessory are partially inserted into the grooves of the wall support member.
Figure 7C:
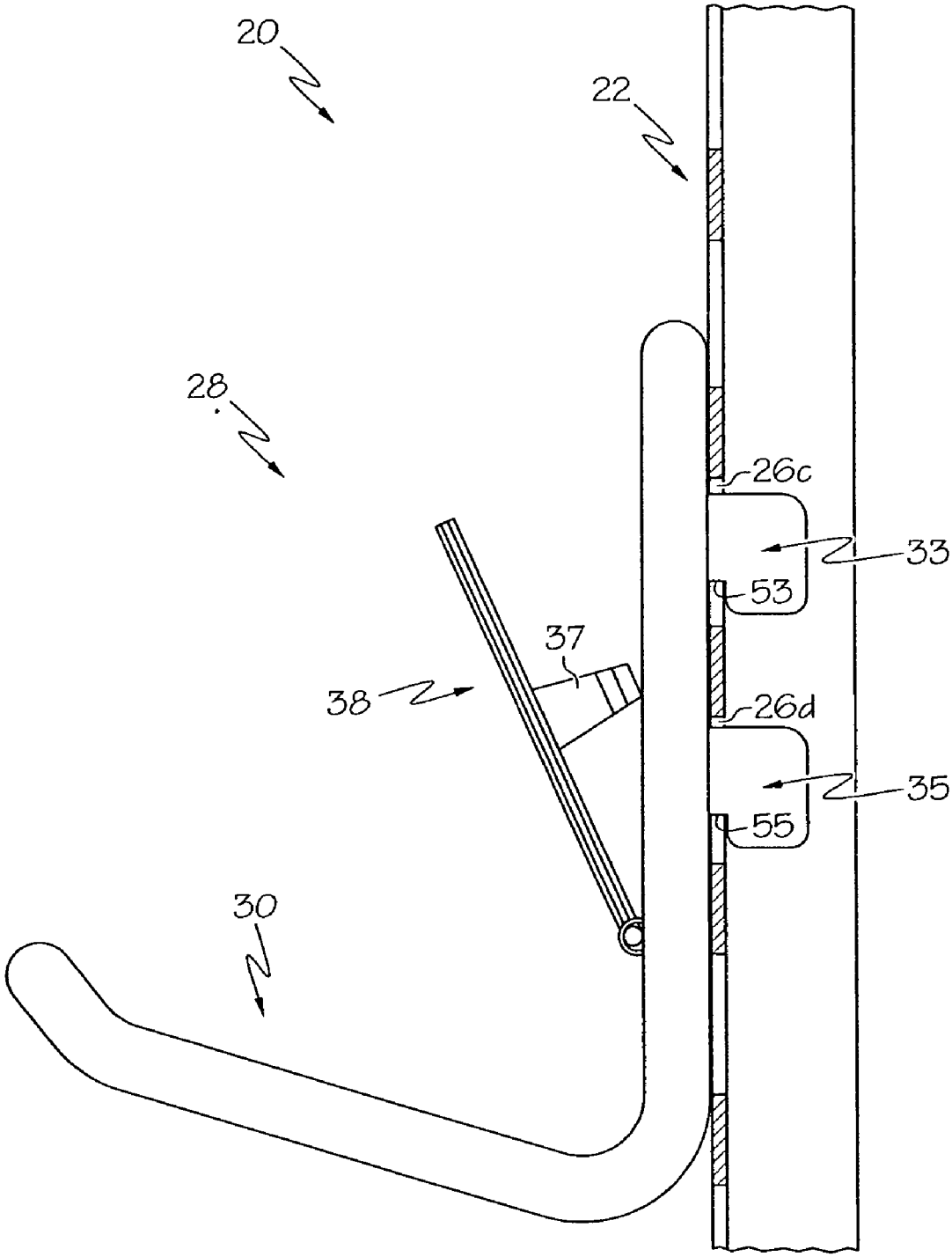
FIG. 7C is a side view depicting a portion of the storage system of FIG. 1, wherein the wall support member is shown in cross-section, the hanging tabs of the storage accessory are fully inserted into the grooves of the wall support member, the hanging tabs are not hooked upon the grooves, and the locking member is in an unlocked position.
Figure 7D:
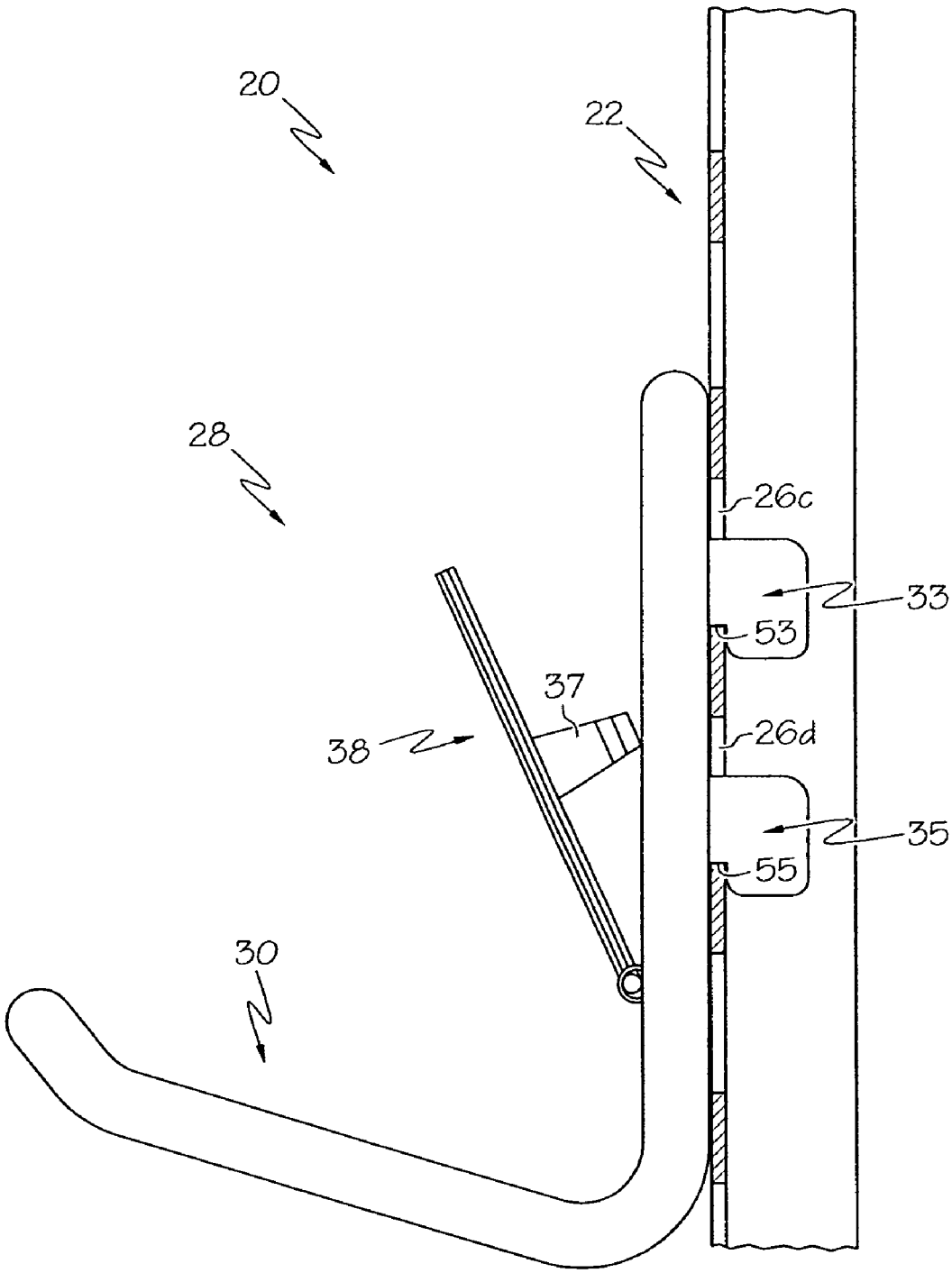
FIG. 7D is a side view depicting a portion of the storage system of FIG. 1, wherein the wall support member is shown in cross-section, the hanging tabs of the storage accessory are fully inserted into the grooves of the wall support member, the hanging tabs are hooked upon the grooves, and the locking member is in an unlocked position.
Figure 7E:
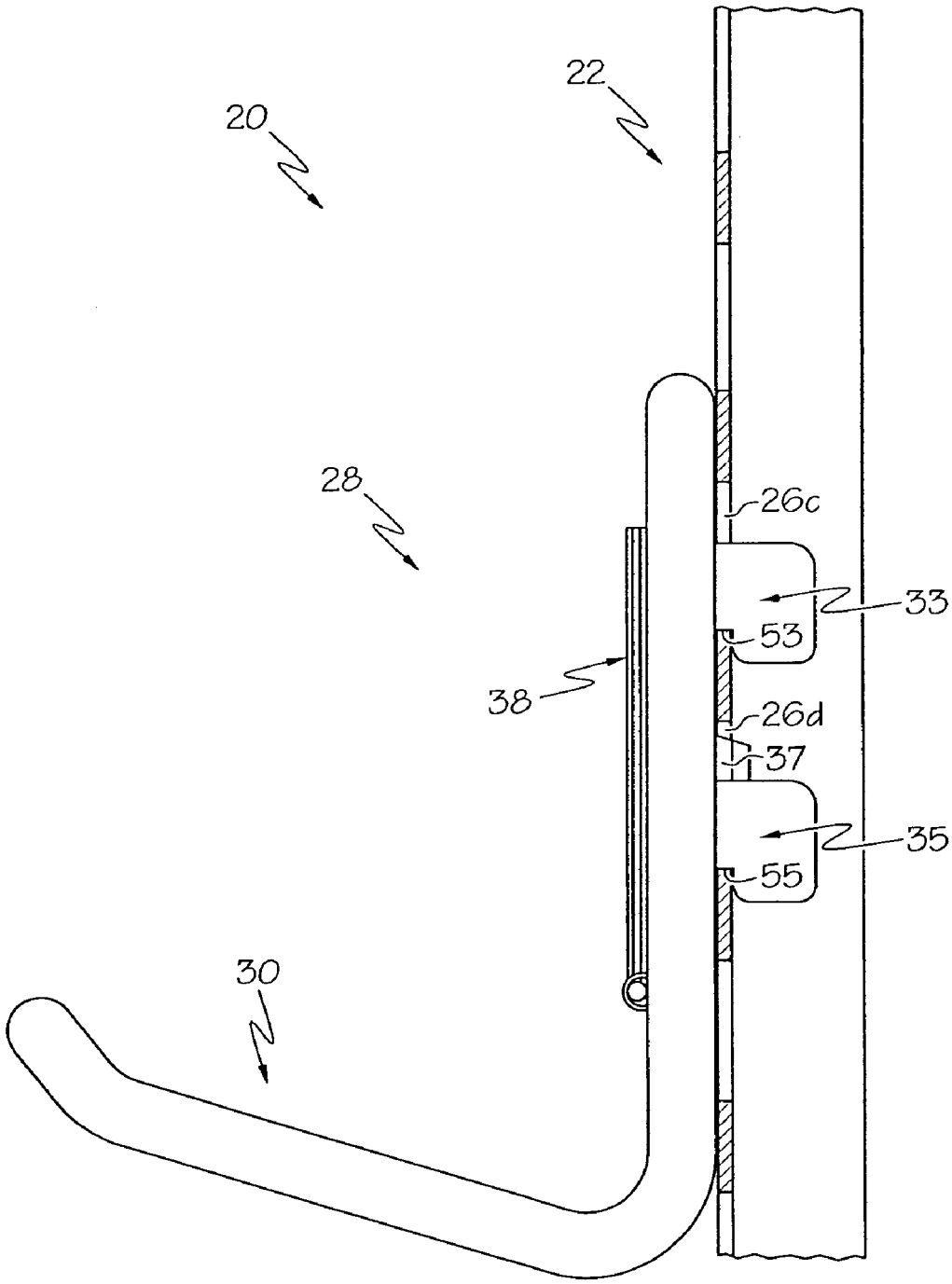
FIG. 7E is a side view depicting a portion of the storage system of FIG. 1, wherein the wall support member is shown in cross-section, the hanging tabs of the storage accessory are fully inserted into the grooves of the wall support member, the hanging tabs are hooked upon the grooves, and the locking member is in a locked position.

FIGS. 7A-7E depict a sequential process of attaching the storage accessory 28 to the wall support member 22. It will be appreciated that the process of detaching or removing the storage accessory 28 from the wall support member 22 can be achieved by reversing this process. The wall support member is shown in FIGS. 7A-7E to comprise grooves 26*a*, 26*b*, 26*c*, 26*d*, 26*e*, and 26*f*. The storage accessory 28 is shown in FIG. 7A to be positioned such that its hanging tabs 33 and 35 are positioned adjacent to the grooves 26*c* and 26*d* in the wall support member 22, but not to be inserted into the grooves 26*c* and 26*d*. FIG. 7B depicts the storage accessory 28 positioned such that its hanging tabs 33 and 35 are partially inserted into the grooves 26*c* and 26*d* in the wall support member 22. FIG. 7C depicts the storage accessory 28 positioned such that its hanging tabs 33 and 35 are fully inserted into the grooves 26*c* and 26*d* in the wall support member 22. However, the ledges 53 and 55 do not contact the wall support member 22, and the storage accessory 28 is accordingly not attached to the wall support member 22. The locking member 38 is also depicted in FIG. 7C to be in an unlocked position.

FIG. 7D depicts the storage accessory 28 positioned such that its hanging tabs 33 and 35 are fully inserted into the grooves 26*c* and 26*d* in the wall support member 22. The ledges 53 and 55 are depicted as contacting the wall support member 22 such that the storage accessory 28 is accordingly attached to the wall support member 22. However, the locking member 38 is depicted in FIG. 7D to be in an unlocked position. FIG. 7E depicts the arrangement of FIG. 7D except that the locking member 38 and its locking tabs (e.g., 37) are shown to be in a locked position.

Figure 2:
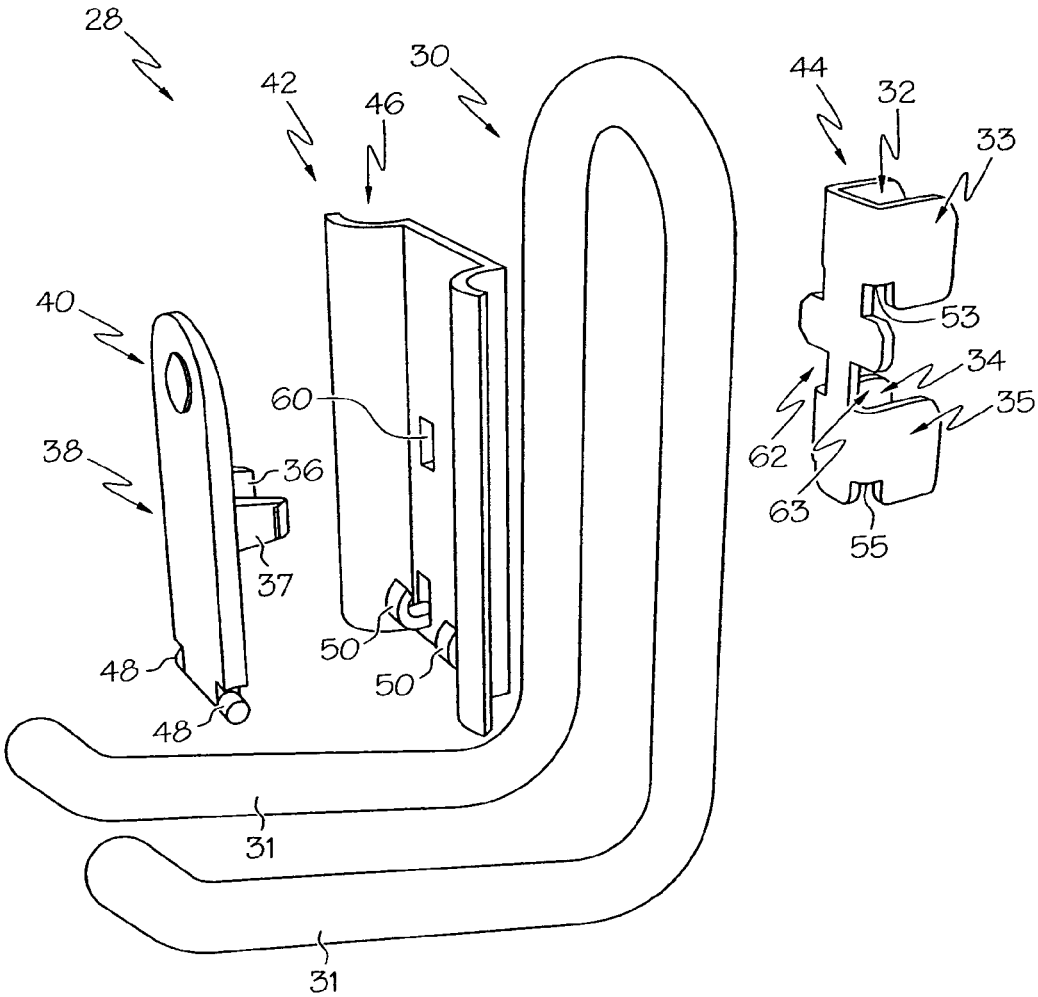
FIG. 2 is a front perspective view depicting the storage accessory of the storage system of FIG. 1, wherein the storage accessory is shown as being disassembled.
Figure 3:
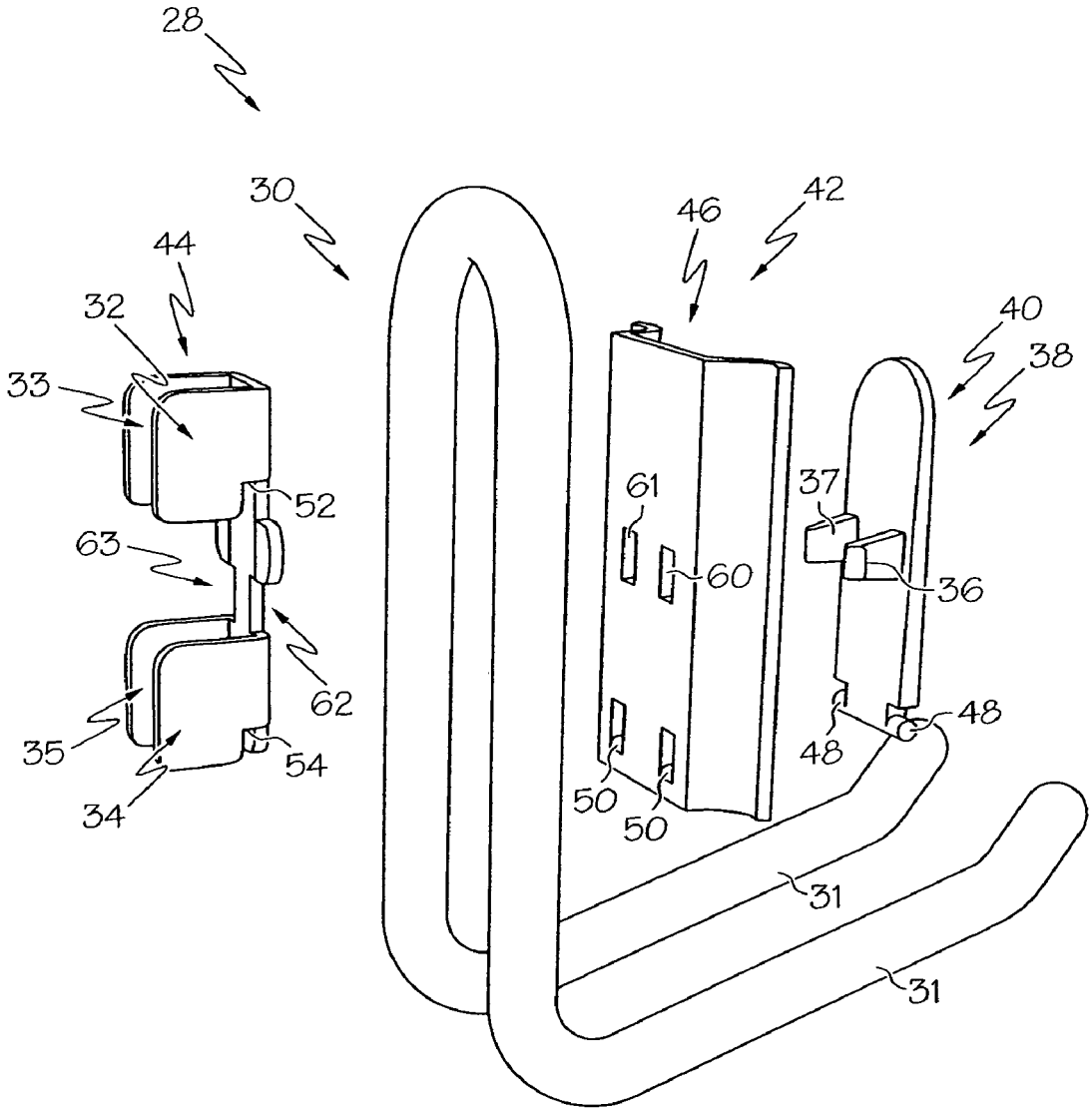
FIG. 3 is a rear perspective view depicting the storage accessory of the storage system of FIG. 1, wherein the storage accessory is shown as being disassembled.
Figure 4:
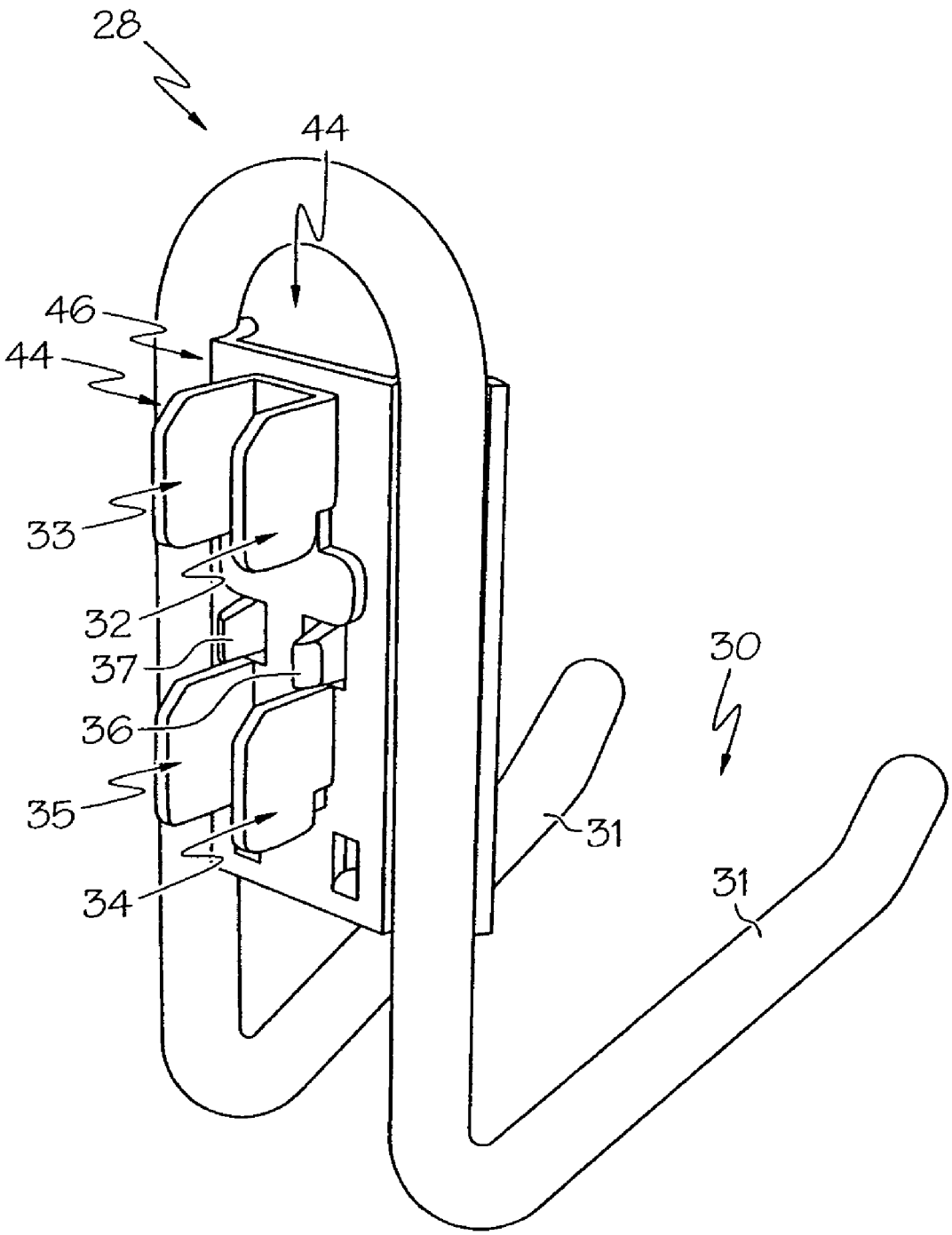
FIG. 4 is a rear perspective view depicting the storage accessory of the storage system of FIG. 1, wherein the storage accessory is shown as being assembled.

In the embodiment of FIG. 7E, it can be seen that, when the locking member 38 and the locking tab 37 are in the locked position, a portion of the locking tab 37 is disposed adjacent to the hanging tab 35 within the groove 26*d* in the wall support member 22. It will be appreciated that this positioning of the locking tab 37 with respect to the hanging tab 35 prevents the hanging tab 35 from being removed from the groove 26*d* in the wall support member 22, and resultantly prevents removal of the storage assembly 28 from the wall support member 22. Additionally, each of the hanging tab 35 and the locking tab 37 are shown to project from the retention member 42 in a substantially parallel and common direction. The locking member 38 is shown in FIG. 2 to comprise multiple locking tabs 36 and 37 which are configured to selectively and simultaneously penetrate at least one groove in a wall support member. Although not specifically depicted in FIG. 7E, it will be appreciated that when the storage accessory 28 is attached to the wall support member 22 as in FIG. 7E, the locking tab 36 interacts with the hanging tab 34 within another groove (e.g., 24) of the wall support member 22 so that the locking tabs 36 and 37 function together to selectively lock the storage accessory 28 to the wall support member 22. Although the embodiment of FIGS. 1-4 and 7A-7E contemplates penetration of the respective locking tabs 36 and 37 into respective grooves 24 and 26, it will be appreciated that, in an alternative embodiment of the present invention, both of the locking tabs 36 and 37 can penetrate a common groove in a wall support member (as perhaps might additionally multiple hanging tabs of the storage accessory). In yet an alternative embodiment of the present invention, a storage accessory (e.g., otherwise similar to that of FIGS. 1-4) might only comprise a single locking tab.

The locking member 38 accordingly provides a positive locking mechanism such that an operator of the storage accessory 28, upon quick glance, can visually verify whether the storage accessory is locked in place upon the wall support member 22. It will be appreciated, as shown in the embodiment of FIGS. 1-4, that the locking member 38 cannot move to its locked position if the storage mechanism is not fully attached with respect to the wall support member 22. Also, it is unlikely that the locking member 38 can be accidentally moved from its locked position to its locked position.

The storage accessory 28 of FIGS. 1-4 and 7A-7E is shown to include locking tabs 36 and 37 which are configured to penetrate respective groove(s) in a wall support member which each respectively receive hanging tabs 34 and 35 of the storage accessory 28. In this manner, the locking tabs 36 and 37 function to selectively block the hanging tabs 34 and 35 from being removed from the groove(s). In an alternative embodiment of the present invention, a storage system might include a storage accessory having one or more locking tabs which are configured to selectively penetrate one or more different groove(s) in a wall support member than is/are penetrated by hanging tabs of the storage accessory. Such a storage system can be achieved through use of the wall support member 22 of FIG. 1, for example, provided that the locking tabs of the storage accessory are configured to selectively penetrate grooves of the wall support member 22 which are not simultaneously penetrated by hanging tabs of the storage accessory.

Figure 8:
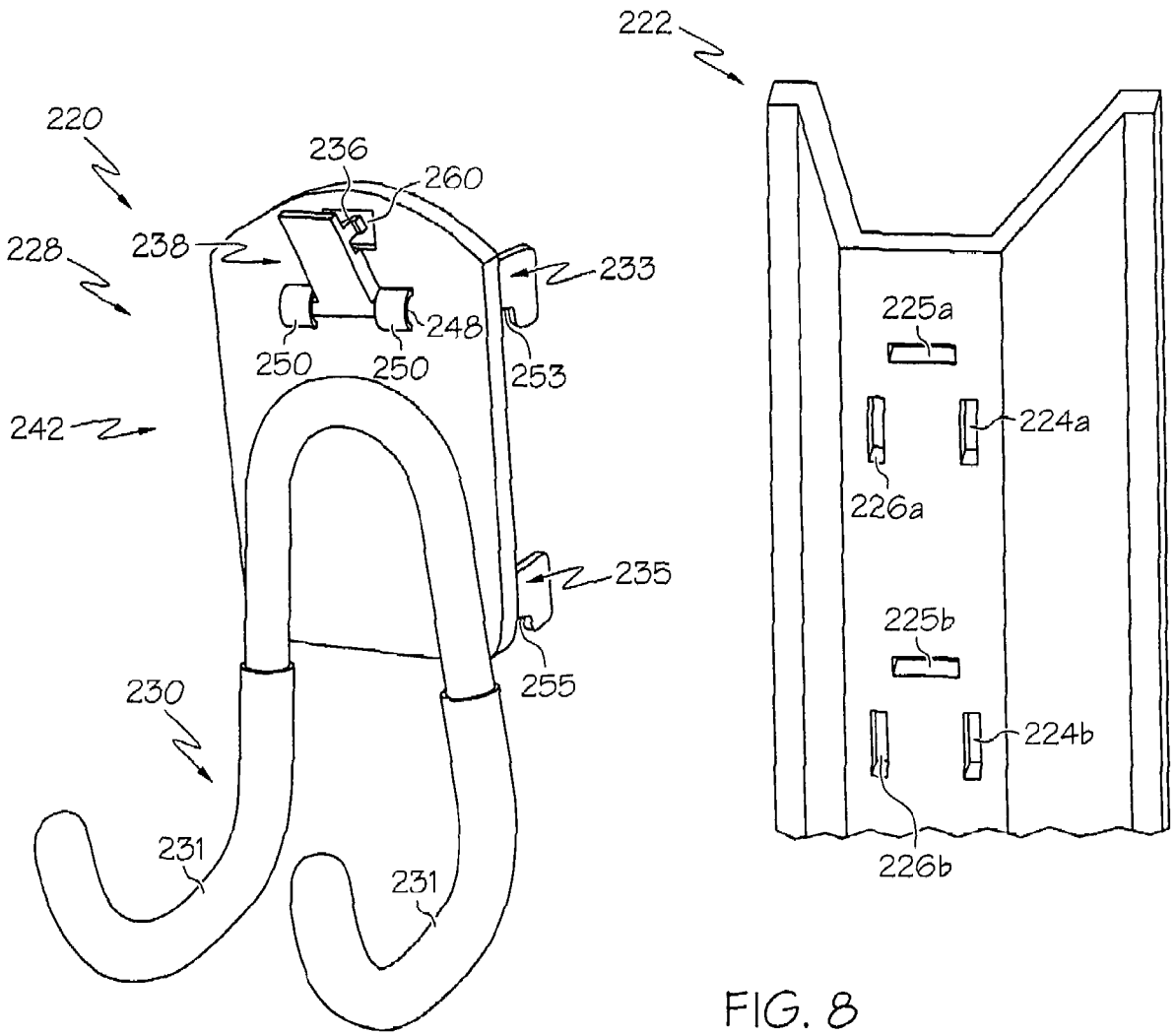
FIG. 8 is a front perspective view depicting a storage system in accordance with an alternative embodiment of the present invention.

Another such storage system can be achieved through use of a customized wall support member which includes provisions especially adapted for receiving one or more locking tabs. For example, as shown in FIG. 8, a storage system 220 includes a wall support member 222 and a storage accessory 228. The wall support member 222 is shown to include grooves 224*a*, 224*b*, 225*a*, 225*b*, 226*a*, and 226*b*. The storage accessory 228 includes a retention member 242, a locking member 238, and a utility member in the form of a hook 230 having support portions 231. The retention member 242 includes hanging tabs (e.g., 233 and 235) which are configured for insertion into respective grooves (e.g., 224*a* and 224*b*) in the wall support member 222 such that respective ledges (e.g., 253 and 255) of the hanging tabs (e.g., 233 and 235) contact the wall support member 222 to facilitate attachment of the storage accessory 228 to the wall support member 222.

The locking member 238 is shown to include a locking tab 236. The locking member 238 is also shown to include tabs 248 which are captured by hooks 250 provided by the retention member 242 to provide a pivotal and hinged connection of the locking member 238 with respect to the retention member 242. When the locking member 238 is in an unlocked position, as shown in FIG. 8, the locking tab 236 does not penetrate the groove 225*a* in the wall support member 222, and the storage accessory 228 can accordingly be detached from the wall support member 222. However, when the locking member 238 is in a locked position, the locking tab 236 penetrates an aperture 260 in the retention member 242 as well as a groove (e.g., 225*a*) in the wall support member 222, and thus prevents the storage accessory 228 from being detached from the wall support member 222.

Figure 9:
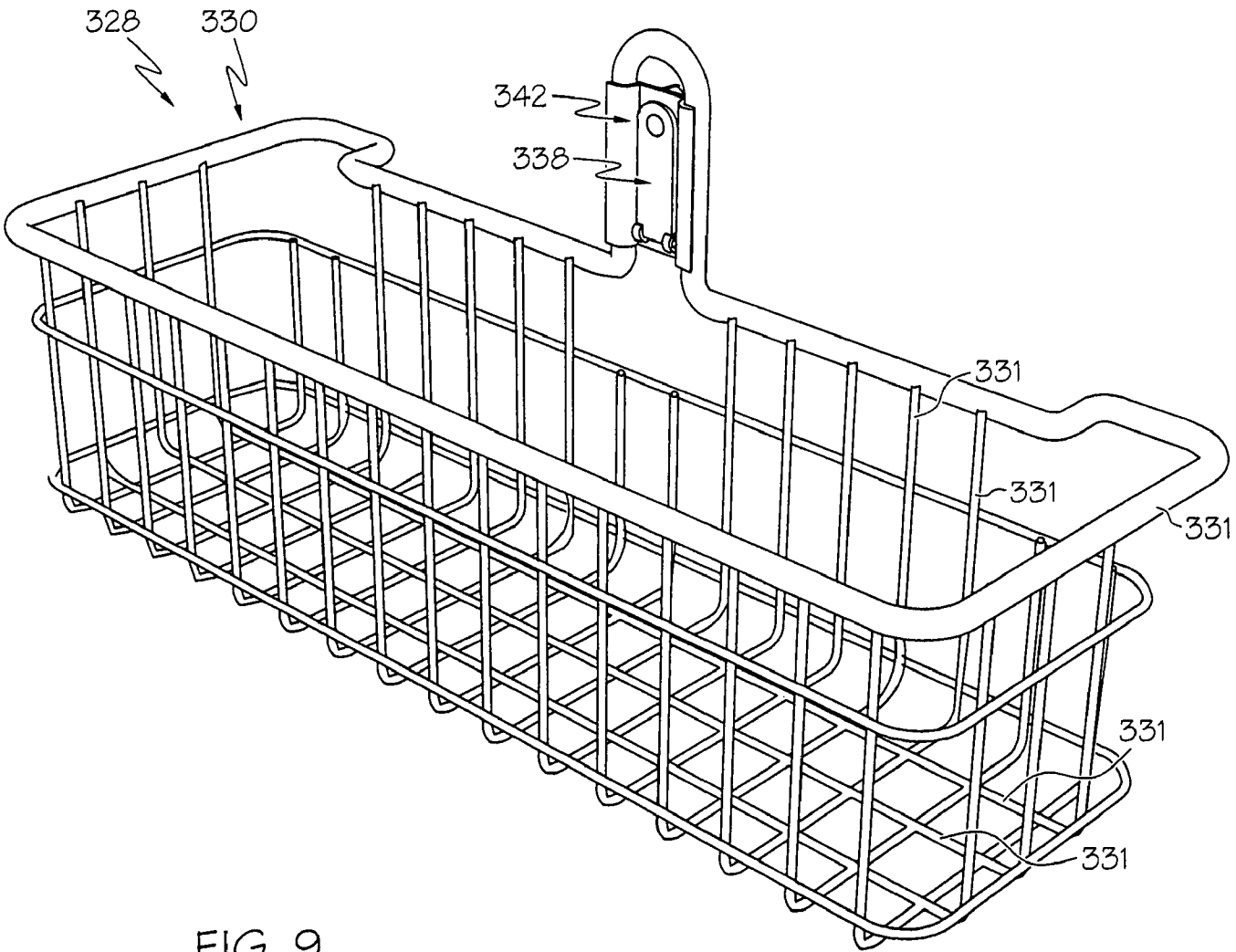
FIG. 9 is a front perspective view depicting a storage accessory in accordance with an alternative embodiment of the present invention.
Figure 10:
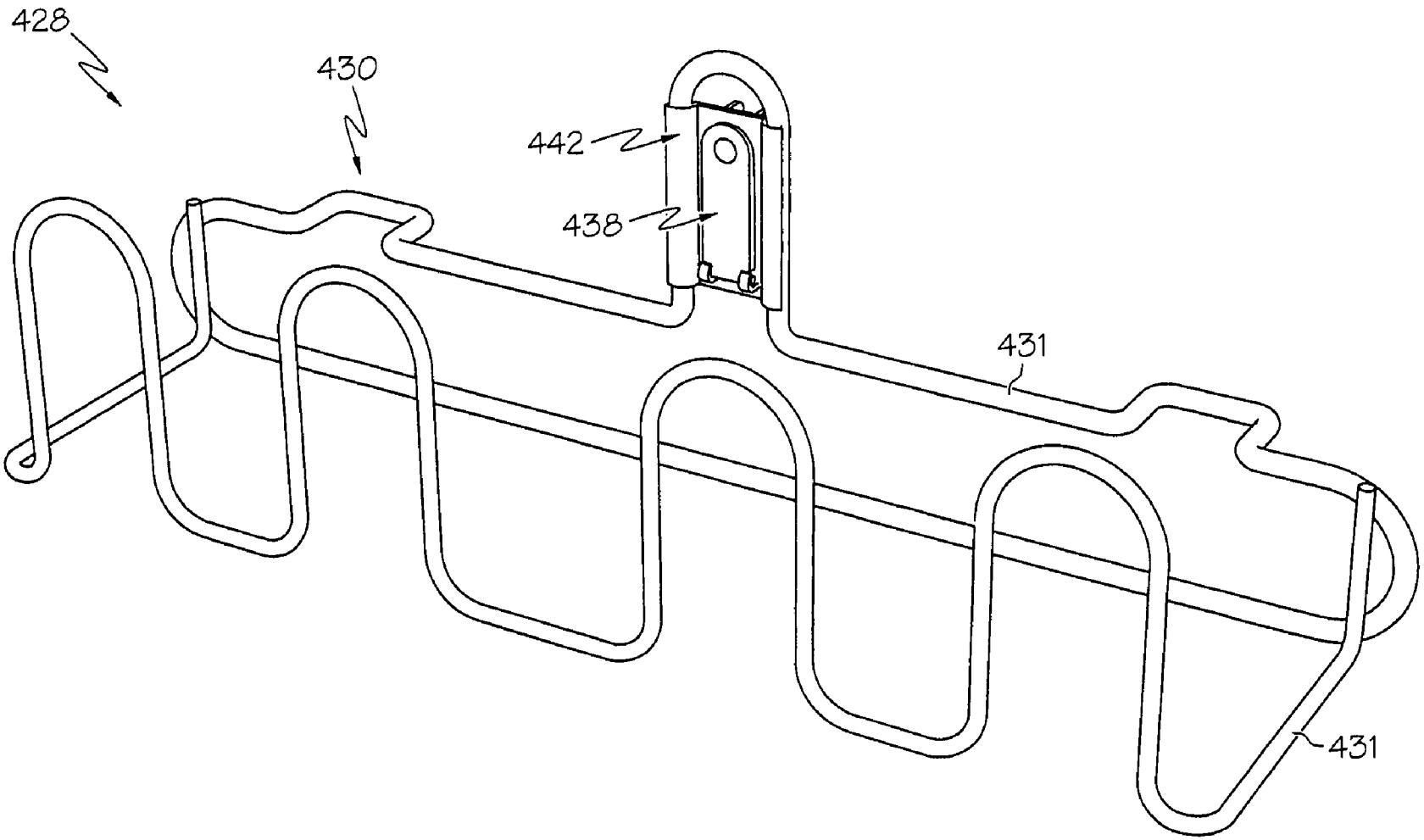
FIG. 10 is a front perspective view depicting a storage accessory in accordance with another alternative embodiment of the present invention.
Figure 11:
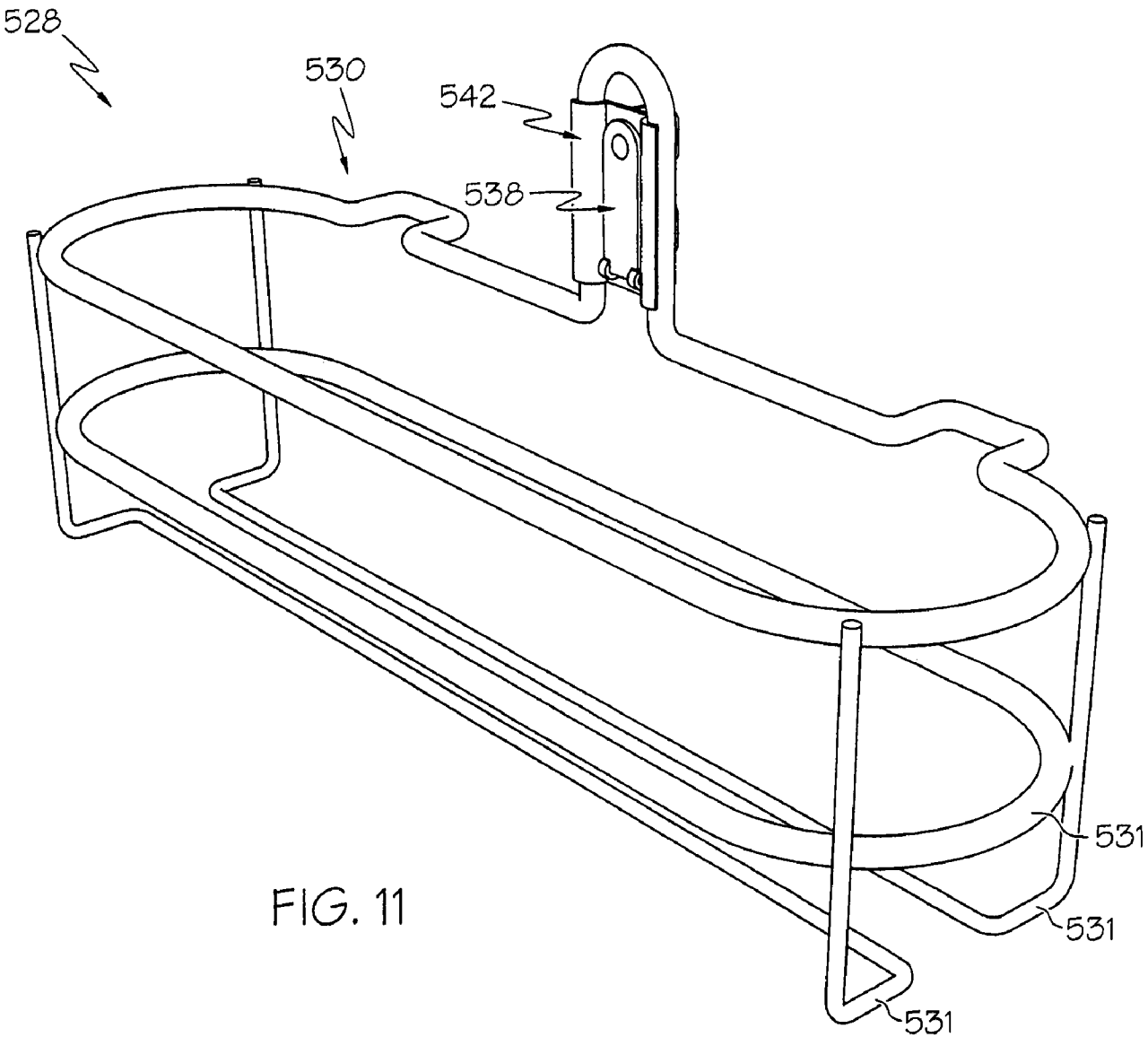
FIG. 11 is a front perspective view depicting a storage accessory in accordance with yet another alternative embodiment of the present invention.

FIGS. 9-11 depict other varieties of storage accessories in accordance with other embodiments of the present invention. In particular, FIG. 9 depicts a storage assembly 328 having a utility member comprising a basket 330, wherein the basket is defined by multiple support portions 331. The storage assembly 328 also includes a retention member 342 and a locking member 338 which, in accordance with one embodiment of the present invention, can be similar to those described above with respect to FIGS. 1-4. FIG. 10 depicts a storage assembly 428 having a utility member comprising a multi-hook assembly 430, wherein the multi-hook assembly is defined by multiple support portions 431. The storage assembly 428 also includes a retention member 442 and a locking member 438 which, in accordance with one embodiment of the present invention, can be similar to those described above with respect to FIGS. 1-4. FIG. 11 depicts a storage assembly 528 having a utility member comprising a bin 530, wherein the bin is defined by multiple support portions 531. The storage assembly 528 also includes a retention member 542 and a locking member 538 which, in accordance with one embodiment of the present invention, can be similar to those described above with respect to FIGS. 1-4. Again, it will be appreciated that storage assemblies in accordance with other embodiments of the present invention can include utility members having any of a variety of shapes, sizes, configurations, and potential uses.

Accordingly, it will be appreciated that a storage accessory in accordance with one embodiment of the present invention can be securely attached to a wall support member such that the storage accessory is unlikely to become detached from the wall support member unless detachment is intended by an operator. However, the storage accessory can be detached from the wall support member at any time and without need for tools. As such, a storage accessory in accordance with one embodiment of the present invention is easy and quick to attach, lock, unlock, detach, reposition and relock with respect to a wall support member, all without any need for tools.

Having shown and described the preferred embodiments of the present invention, further adaptations of the support assembly of the present invention as described herein can be accomplished by appropriate modifications by one of ordinary skill in the art without departing from the scope of the present invention. Several of these potential modifications and alternatives have been mentioned, and others will be apparent to those skilled in the art. Accordingly, the scope of the present invention should be considered in terms of the following claims and is understood not to be limited to the details of structure, operation or process steps as shown and described in the specification and drawings.

What is claimed is:

1. A storage system comprising:

a wall support member comprising a groove;

a storage accessory comprising:

a utility member configured for supporting an item; and a retention member comprising a hanging tab configured for selective insertion into the groove to facilitate hanging of the storage accessory upon the wall support member; and a locking tab moveably connected to the retention member such that the locking tab is moveable relative to the retention member between a locked position and an unlocked position while remaining moveably connected to the retention member such that the locking tab is configured, when in the locked position, to selectively interface the wall support member to prevent removal of the hanging tab from the groove in the wall support member and, when in the unlocked position, the locking tab configured to rest in the unlocked position to facilitate selective removal of the hanging tab from the groove in the wall support member.

2. The storage system of claim 1 wherein the storage accessory is configured, when the locking tab is in the locked position, such that at least a portion of the locking tab removably penetrates through the retention member and into the groove in the wall support member and, when the locking tab is in the unlocked position, such that no portion of the locking tab penetrates through the retention member and into the groove in the wall support member.

3. The storage system of claim 2 wherein the storage accessory is configured, when the locking tab is in the locked position, such that the at least a portion of the locking tab is configured for disposition adjacent to the hanging tab within the groove.

4. The storage system of claim 1 wherein the storage accessory is configured, when the locking tab is in the locked position, such that each of the hanging tab and the locking tab project with respect to the utility member in a substantially parallel and similar direction.

5. The storage system of claim 1 wherein the wall support member comprises a rail.

6. The storage system of claim 1 wherein the wall support member comprises multiple grooves and the storage accessory comprises multiple hanging tabs, and wherein each of the hanging tabs is configured for selective simultaneous insertion into a respective groove.

7. The storage system of claim 6 wherein the storage accessory comprises multiple locking tabs, and wherein each of the locking tabs is configured for selective simultaneous insertion into one of the respective grooves.

8. The storage system of claim 1 wherein the locking tab is hingedly movable between the locked position and the unlocked position.

9. The storage system of claim 1 wherein the utility member comprises a hook.

10. The storage system of claim 1 wherein the utility member comprises a basket.

11. A storage accessory configured for selective attachment to a wall support member, the storage accessory comprising:

a retention member comprising a hanging tab configured for selective insertion into a groove in a wall support member, wherein the hanging tab includes a ledge configured for selectively contacting a wall support member to facilitate hanging of the storage accessory upon a wall support member;

a utility member configured for supporting an item; and a locking member comprising a locking tab, the locking tab being movable with respect to the retention member while connected to the retention member between an unlocked position and a locked position such that, in the unlocked position, the locking tab configured to rest in the unlocked position and not to penetrate a groove in a wall support member and thus to allow removal of the hanging tab from a wall support member and, in the locked position, the locking tab is configured to penetrate a groove in a wall support member and thus to prevent removal of the hanging tab from a wall support member.

12. The storage accessory of claim 11 wherein the locking member is hingedly attached to the retention member such that the locking member rotates from the unlocked position to the locked position with the locking tab configured to penetrate an aperture in the retention member to penetrate the groove in the wall support member.

13. The storage accessory of claim 11 wherein the locking member comprises a grip portion configured to facilitate use of an operator's finger to effectuate movement of the locking tab.

14. The storage accessory of claim 11 wherein the retention member comprises an aperture and the locking tab is configured to pass through the aperture and into a groove in a wall support member when the locking tab is in the locked position.

15. The storage accessory of claim 11 wherein each of the hanging tab and the locking tab, when in the locked position, are configured to project in a substantially parallel and common direction.

16. The storage accessory of claim 11 wherein the hanging tab comprises multiple hanging tabs each being configured for selective simultaneous insertion into at least one groove in a wall support member.

17. The storage accessory of claim 11 wherein the locking tab comprises multiple locking tabs each being configured for selective simultaneous penetration of at least one groove in a wall support member.

18. The storage accessory of claim 11 wherein the utility member is attached to the retention member by welding.

19. The storage accessory of claim 11 wherein the utility member comprises a hook.

20. The storage accessory of claim 11 wherein the utility member comprises a basket.

21. A storage accessory configured for selective attachment to a wall support member, the storage accessory comprising:

a retention member comprising a first hanging tab, a second hanging tab, a third hanging tab, and a fourth hanging tab, wherein each of said hanging tabs are configured for selective insertion into respective grooves in a wall support member to facilitate hanging of the storage accessory upon a wall support member, and wherein each of the first hanging tab and the second hanging tab are horizontally aligned and spaced from one another, each of the third hanging tab and the fourth hanging tab are horizontally aligned and spaced from one another, each of the first hanging tab and the third hanging tab are vertically aligned and spaced from one another, and each of the second hanging tab and the fourth hanging tab are vertically aligned and spaced from one another;

a utility member attached with respect to the retention member and configured for supporting an item; and a locking member hingedly attached to the retention member and comprising a first locking tab and a second locking tab, the locking member being movable with respect to the retention member between an unlocked position and a locked position such that the locking member remains in the unlocked position and locked position without application of a manual force thereto wherein, in the unlocked position, the first locking tab and the second locking tab are both configured not to penetrate a wall support member and are located outside the wall support member with the locking member hingedly attached to the retention member, thereby allowing removal of said hanging tabs from a wall support member and, in the locked position, the first locking tab is configured to penetrate a groove in a wall support member in which the first hanging tab is inserted, and the second locking tab is configured to penetrate a groove in a wall support member in which the second hanging tab is inserted.

* * * * *